United States Patent [19]

Glazunov et al.

[11] 4,240,497

[45] Dec. 23, 1980

[54] VACUUM METAL DIE-CASTING APPARATUS

[76] Inventors: Sergei G. Glazunov, Leninsky prospekt, 41, kv. 62; Alexei M. Khromov, Ukhtomskaya ulitsa, 36a, kv. 19; Vasily V. Merkulov, 3 Dorozhny proezd, 10, korpus 2, kv. 27; Igor B. Krjuchkov, Begovaya ulitsa, 22, korpus 16, kv. 68; Nikolai E. Klimov, Aviamotornaya ulitsa, 4, korpus 4, kv. 253; Dmitry A. Filippov, Saratovskaya ulitsa, 8/10, kv. 138, all of Moscow, U.S.S.R.

[21] Appl. No.: 869,475

[22] Filed: Jan. 16, 1978

[51] Int. Cl.[3] ..... B22D 17/10; B22D 17/14; B22D 17/20; B22D 18/06

[52] U.S. Cl. ..... 164/158; 164/253; 164/312; 164/314

[58] Field of Search ..... 164/253, 256, 314, 312, 164/158, 257, 303, 61, 65

[56] References Cited

U.S. PATENT DOCUMENTS

| | | | |
|---|---|---|---|
| 3,009,218 | 11/1961 | Rearwin | 164/257 |
| 3,019,495 | 2/1962 | Cornell | 164/256 X |
| 3,248,762 | 5/1966 | Wagner | 164/158 |
| 3,700,026 | 10/1972 | Adachi et al. | 164/256 |

FOREIGN PATENT DOCUMENTS

| | | | |
|---|---|---|---|
| 914508 | 1/1963 | United Kingdom | 164/258 |

*Primary Examiner*—Robert D. Baldwin
*Assistant Examiner*—Gus T. Hampilos
*Attorney, Agent, or Firm*—Lackenbach, Lilling & Siegel

[57] ABSTRACT

A vacuum apparatus comprises a frame which carries two vertical plates with a mobile plate mounted in guides therebetween. One die portion or part of a split die is rigidly fixed on the mobile plate by means of a die holder ,telescopically connected to a vacuum casting chamber housing rigidly mounted on a stationary plate which carries the other die portion or half of said die. Air-tight seals are provided at the housing joints and the housing is provided with viewing ports and with means for cleaning a die cavity.

5 Claims, 2 Drawing Figures

VACUUM METAL DIE-CASTING APPARATUS

BACKGROUND OF THE INVENTION

1. Field of the Invention

The invention relates to foundry practice, and more particularly to vacuum metal die-casting apparatus of the type intended preferably for producing precision castings from refractory and highly reactive metals and alloys, such as those based on titanium or zirconium.

2. Description of the Prior Art

British Patent Specification No. 914,508 discloses a metal die-casting apparatus which comprises a frame having mounted thereon an air-tight housing common to both melting and casting chambers. Enclosed in said common housing are two stationary vertical plates interconnected by guide columns. Mounted in the guide columns is a mobile plate provided with a reciprocating drive means. Within said air-tight housing is an electrode holder mounted over a crucible for rotation about a horizontal axis and it is provided with a drive means for providing rotation to said electrode holder.

Underneath the crucible is a funnel placed in the pouring orifice of a pressure chamber housing.

The pressure chamber housing is built into a stationary plate which carries one half of a die, the second half thereof being secured to a mobile plate. The pressure chamber incorporates a means for the forced supply of metal into the die, and said means being basically a piston secured to a piston rod of a hydraulic cylinder.

It is a matter of practical knowledge that when metal is forced into the die there is insufficient rigidity of connection between the two half-dies so that flash is invariably formed at the parting planes of the die, the casting then losing accuracy of size and/or shape.

Further development of the machine-building industry generates higher demands for large quantities of metal die-casting blanks. Particularly severe problems are encourtered in known apparatus for die casting precision blanks from highly reactive metals and alloys, such as titanium- or zirconium-based alloys and a solution to these problems is a central necessity.

SUMMARY OF THE INVENTION

It is therefore an object of the invention to provide a vacuum metal die casting apparatus which improves the quality of castings.

Another no less important object of the invention is to enhance the operating reliability of such apparatus.

These and other objects are attained by the provision of a vacuum metal die casting apparatus comprising a frame having two stationary vertical plates interconnected by horizontal guide columns and wherein a further plate is a mobile plate carrying one half of a die, and the second half of said die is rigidly connected to one of said stationary plates which is provided with a pressure chamber housing and a die gate both communicating with the die cavity. Means are also provided for a forced supply of metal through the pressure chamber into the die, and, one of the half-dies is held in position by a die holder telescopically connected to a casting chamber housing rigidly attached to one stationary plate, and it is also provided with air-tight seals and with a viewing port.

As the casting chamber housing is built of telescopically connected parts rigidly attached to vertical plates, it accurately positions the mobile plate when the liquid metal is forced into the die. Air-tight seals make it possible to remove the castings from the cavity of the die without depressurizing the apparatus, and to reduce the overall dimensions of the vacuum chamber and to locate externally with respect to the vacuum chamber both a drive means for actuating the mobile plate and a thrusting hinged mechanism. One or more viewing ports in the housing facilitates the operation of the die and makes it possible to check visually the casting of metal blanks and their quality.

It is advantageous to also provide means for cleaning the die cavity to the vacuum casting chamber housing with the aid of a spherical pivot and to form said means with a rod carrying a detachable actuating tool. Such an arrangement makes it possible to clean the casting die without depressurizing the casting chamber and thus improves the quality of casting, i.e. makes them as close as is practically possible to the ideal size and/or shape.

BRIEF DESCRIPTION OF THE DRAWINGS

These and other objects and features of the invention become readily apparent from one embodiment thereof which will now be described by way of example with reference to the accompanying drawings, in which.

DESCRIPTION OF THE PREFERRED EMBODIMENT

Figure 1:
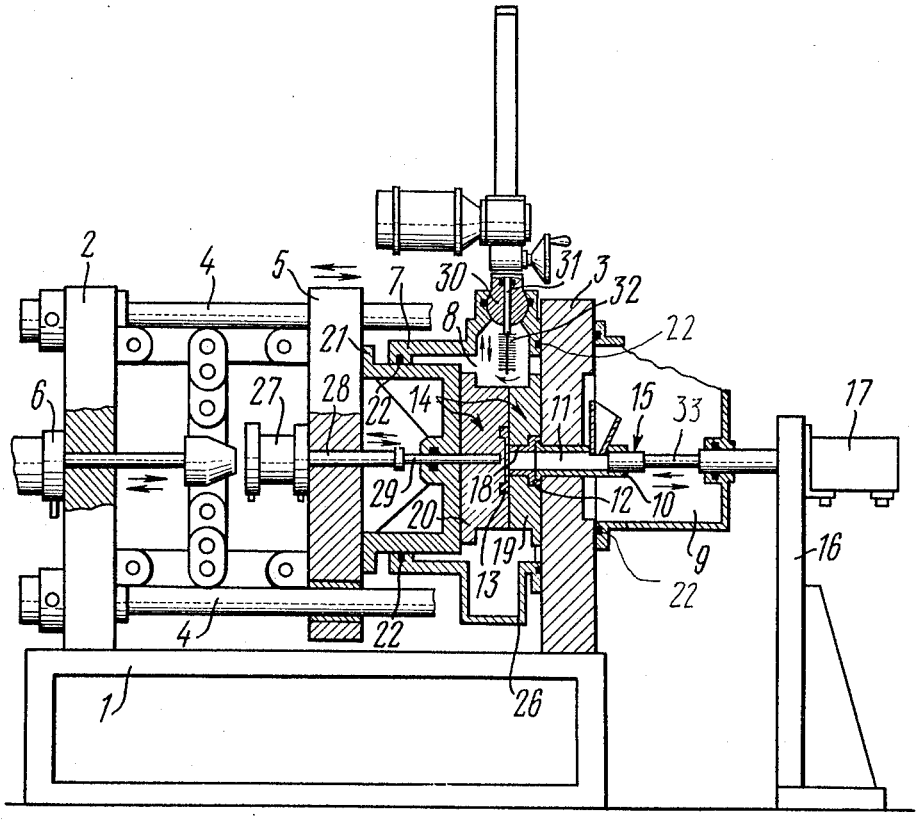
FIG. 1 is a side elevational view of the apparatus of the invention but with some elements thereof shown in cross section and partially broken away.

A metal die casting apparatus has a frame 1 (FIG. 1) and rigidly attached thereto are a plurality of vertical plates 2 and 3 interconnected by horizontal guide columns 4 (FIG. 2) and wherein mounted on the columns 4 for reciprocation under the action of a drive means 6 is a third mobile plate 5 disposed between said two vertical plates.

Rigidly mounted on the stationary plate 3 (FIG. 1) is an air-tight housing 7 of a vacuum casting chamber 8. The vertical plate 3 separates the vacuum casting chamber 8 of the apparatus from a vacuum melting chamber 9. A housing 10 of a pressure chamber 11 is built into the vertical stationary plate 3 and is connected to a gate 12 (situated in a flanged borehole 18 in the die portion 19) communicating with the pressure chamber 11 and a cavity 13 of the die 14.

The pressure chamber 11 is fitted with a piston or plunger means 15 for the forced supply of metal into the die 14. Said means 15 incorporates a hydraulic cylinder 17 with a rod 33 entering the pressure chamber 11, and the hydraulic cylinder is supported by a leg 16.

One half-die 19 is rigidly fastened to the stationary vertical plate 3, whereas the second half-die 20, is secured to a die holder 21 rigidly mounted on the mobile plate 5.

The improvement in the vacuum die casting apparatus, according to the invention, consists in that the vacuum casting chamber 8 has its own air-tight housing 7 attached, on the one hand, to the stationary plate 3 and telescopically connected, on the other hand, to the die holder 21 which is rigidly mounted on the mobile plate 5. Air-tight seals 22 are provided at the joints of the housing 7.

Figure 2:
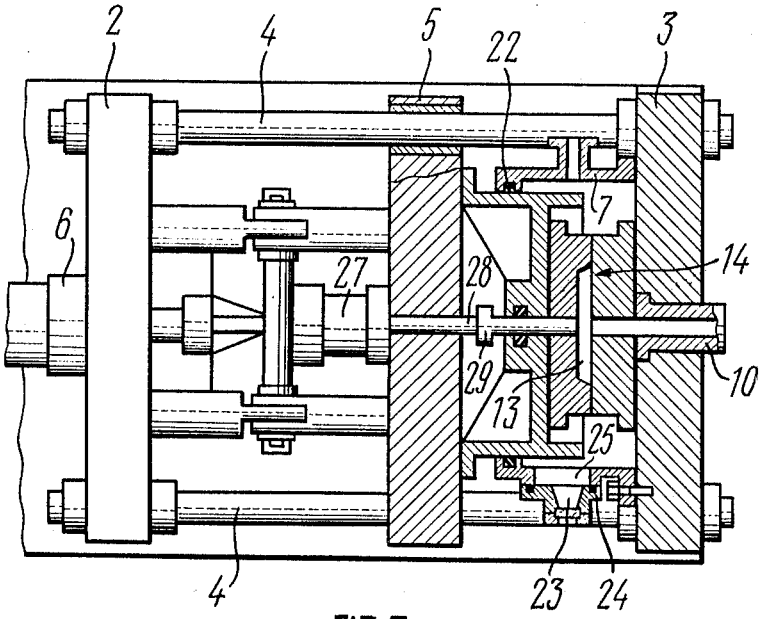
FIG. 2 is a partial top plan view of the apparatus of FIG. 1 with some elements thereof in section.

The housing 7 of the vacuum casting chamber 8 is fitted with viewing ports 23 (FIG. 2) and with ports 25 incorporating covers 24 for servicing the die 14. A hopper 26 is provided for storing finished metal castings (FIG. 1).

A hydraulic cylinder 27, provided with a rod 28 cooperating with a pusher 29 enters the cavity 13 of the die 14 for facilitating the removal of a finished metal casting (not shown on the drawings), is attached externally with respect to the vacuum casting chamber 8 and to the vertical mobile plate 5.

For cleaning the cavity 13 of the die 14, the apparatus is provided with means having a rod 31 with a detachable actuating tool 32, e.g., a scraper, and said means being attached to the housing 7 of the vacuum casting chamber 8 with the aid of a spherical pivot 30.

The vacuum metal die casting apparatus according to the invention operates as follows.

Vacuum is built up in the vacuum melting chamber 9 (FIG. 1) and the vacuum casting chamber 8 by means of a vacuum plant (not shown on the drawing). The drive means 6 is energized to actuate the plate 5 and ensure an air-tight closing of the halves of the die 14.

The apparatus is supplied with electric current to melt an amount of metal sufficient to cast a specified number of castings, the liquid metal then being transferred to the pressure chamber 11, whereupon a hydraulic cylinder 17 is energized, its rod 33 and piston or plunger means 15 forcing a portion of the metal into the cavity 13 of the die 14. This portion of metal is held for a predetermined time in the die until the casting solidifies.

A finished casting is removed from the cavity 13 of the die 14 by energizing the drive means 6 to move the plate 5 in the reverse direction and so open the half-dies of the die 14, the die holder 21 remaining within the enclosure of the vacuum seals 22 of the casting chamber 8 and also providing a continuous, translational mating sealing surface with the sealing means disposed between the stationary vacuum casting chamber and said die holder. When the mobile plate 5 is backed away from the stationary plate 3, the hydraulic cylinder 17 is energized, its rod 33 pushes out of the gate 12 the solidified excess portion of the metal, as well as the casting, from the half-die 19 of the die 14 which is apart from or may be built into the stationary plate 3. Should the casting fail to fall out of the opened die 14, it is pushed out by the pusher 29 which is actuated by the rod 28 of the hydraulic cylinder 27, the casting then sliding into the hopper 26 of the vacuum casting chamber 8.

Next, the cavity 13 of the die 14 is cleaned of splashes of metal by a scraper tool 32 fastened to the rod 31 of the aforesaid cleaning means and it is capable of reaching any area of said cavity.

Once the two die portions or half-dies of the die 14 are cleaned, the latter is closed by the action of the drive means 6 which is cooperatively associated with and moves the mobile plate 5 toward the stationary plate 3.

This terminates the operating cycle of the apparatus. Note that it is not necessary to depressurize the apparatus, since, as has been experimentally found, the apparatus, according to the invention, can operate faultlessly for a long period of time and it also ensures a high quality to the metal castings.

We claim:

1. An improved multi-cycle, vacuum metal die casting apparatus not requiring depressurization during each recycle comprising: a frame; a plurality of stationary vertical plates attached to said frame; horizontal guide columns interconnecting said vertical plates; a mobile vertical plate slidably mounted between said vertical plates on said horizontal guide columns; a reciprocating drive means cooperatively associated with said mobile plate; a die holder rigidly secured to said mobile plate; a die having two halves, one half thereof being rigidly connected to said die holder, and the other half thereof, to the vertical plate separating a vacuum casting chamber from a melting chamber; a vacuum casting chamber housing being rigidly mounted on the vertical plate carrying said one half of the die; said vacuum casting chamber housing further being telescopically connected to said die holder and being provided with a spherical pivot and means for cleaning the die cavity in the form of a rod having a detachable actuating tool; sealing means provided at the connecting joints of said vacuum casting chamber housing with said die holder and said vertical plate separating said casting and said melting chambers; said die holder providing a continuous, translational mating sealing surface with the sealing means disposed between the stationary vacuum casting chamber housing and said die holder so as to permit the discharge of a finished casting without the need for depressurizing said casting chamber; a pressure chamber housing in said vertical plate connected through a gate to the cavity of said die; and means for the cyclic forced feeding of metal through said pressure chamber into said die.

2. A vacuum metal die casting apparatus according to claim 1, wherein said vacuum casting chamber housing includes ports.

3. A vacuum metal die casting apparatus according to claim 2, wherein some of said ports are viewing ports.

4. A vacuum metal die casting apparatus according to claim 3, wherein the remaining ports are for servicing said die.

5. A vacuum metal die casting apparatus according to claim 1, wherein said vacuum casting chamber housing includes hopper means for storing finished metal castings.

* * * * *